US008910380B2

(12) United States Patent
Law et al.

(10) Patent No.: US 8,910,380 B2
(45) Date of Patent: Dec. 16, 2014

(54) METHOD OF MANUFACTURING INKJET PRINTHEAD WITH SELF-CLEAN ABILITY

(75) Inventors: Kock-Yee Law, Penfield, NY (US); Hong Zhao, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 529 days.

(21) Appl. No.: 12/815,768

(22) Filed: Jun. 15, 2010

(65) Prior Publication Data

US 2011/0304671 A1 Dec. 15, 2011

(51) Int. Cl.
*B41J 2/16* (2006.01)

(52) U.S. Cl.
CPC ..... *B41J 2/1631* (2013.01); *B41J 2/1606* (2013.01); *B41J 2/161* (2013.01); *B41J 2/162* (2013.01); *B41J 2/1628* (2013.01); *B41J 2/1642* (2013.01); *B41J 2/1645* (2013.01); *B41J 2/1646* (2013.01)
USPC ..... 29/890.1; 29/830; 427/258; 427/259; 438/637; 438/700; 347/45; 347/47; 216/39; 216/42

(58) Field of Classification Search
USPC ..... 29/890.1, 830; 347/44–47; 428/429; 427/258, 259, 272; 438/637, 700; 216/39, 41, 42
See application file for complete search history.

(56) References Cited

U.S. PATENT DOCUMENTS 4,719,480 A * 1/1988 Elrod et al. ..... 347/46
4,875,619 A 10/1989 Anderson et al.
5,121,141 A * 6/1992 Hadimoglu et al. ..... 347/46
5,867,180 A 2/1999 Katayama et al.
5,867,189 A 2/1999 Whitlow et al.
6,345,880 B1 * 2/2002 DeBoer et al. ..... 347/45
6,383,642 B1 * 5/2002 Le Bellac et al. ..... 428/429 X
6,720,256 B1 * 4/2004 Wu et al. ..... 438/637 X
7,270,763 B2 * 9/2007 Aoshima ..... 216/41 X
2004/0062867 A1 * 4/2004 Friedmann et al. ..... 427/258
2007/0123606 A1 5/2007 Toma et al.
2009/0046125 A1 2/2009 Nystrom et al.

FOREIGN PATENT DOCUMENTS

JP 57155731 A * 9/1982 ..... 216/41 X
JP 05124200 A * 5/1993 ..... 29/890.1 X

OTHER PUBLICATIONS

U.S. Appl. No. 12/647,945 to Zhao et al., filed Dec. 28, 2009, entitled "Superoleophobic and Superhydrophobic Devices and Method for Preparing Same."
U.S. Appl. No. 12/648,004 to Gulvin at al., filed Dec. 28, 2009, entitled "A Process for Preparing an Inkjet Print Head Front Face Having A Textured Superoleophobic Surface."
U.S. Appl. No. 12/647,977to Zhao at al., filed Dec. 28, 2009, entitled "Superoleopobic Surfaces and Method for Preparing Same."

* cited by examiner

*Primary Examiner* — A. Dexter Tugbang
(74) *Attorney, Agent, or Firm* — Pillsbury Winthrop Shaw Pittman LLP

(57) ABSTRACT

Described is a process for producing an inkjet printhead comprising an aperture face having an oleophobic surface. The process includes forming an aperture plate by disposing a silicon layer on an aperture plate; using photolithography to create a textured pattern on an outer surface of the silicon layer; and chemically modifying the textured surface by disposing a conformal, oleophobic coating on the textured surface. The oleophobic aperture plate may be used as a front face surface for an inkjet printhead.

22 Claims, 9 Drawing Sheets

METHOD OF MANUFACTURING INKJET PRINTHEAD WITH SELF-CLEAN ABILITY

TECHNICAL FIELD

This disclosure is directed to inkjet printheads with self-cleaning ability. More particularly, described herein are inkjet printheads having an aperture plate coated with a superoleophobic film comprising a textured silicon layer with a conformal oleophobic coating disposed on the textured silicon layer, and methods for preparing the same.

RELATED APPLICATIONS

Commonly assigned U.S. patent application Ser. No. 12/647,945, filed Dec. 28, 2009, entitled "Superoleophobic and Superhydrophobic Devices And Method For Preparing Same," which is hereby incorporated by reference herein in its entirety, describes a process for preparing a flexible device having a textured superoleophobic surface comprising providing a flexible substrate; disposing a silicon layer on the flexible substrate; using photolithography to create a textured pattern on the substrate wherein the textured pattern comprises an array of pillars; and chemically modifying the textured surface by disposing a conformal oleophobic coating thereon; to provide a flexible device having a superoleophobic surface and, in embodiments, to provide a flexible device having a surface that is both superoleophobic and superhydrophobic.

Commonly assigned U.S. patent application Ser. No. 12/648,004, filed Dec. 28, 2009, entitled "A Process For Preparing An Inkjet Print Head Front Face Having A Textured Superoleophobic Surface," which is hereby incorporated by reference herein in its entirety, describes a process for preparing an inkjet print head front face or nozzle plate having a textured superoleophobic surface comprising providing a silicon substrate; using photolithography to create a textured pattern on the substrate; and optionally, modifying the textured surface by disposing a conformal oleophobic coating thereon; to provide an inkjet print head front face or nozzle plate having a textured superoleophobic surface.

Commonly assigned U.S. patent application Ser. No. 12/647,977, filed Dec. 28, 2009, entitled "Superoleophobic Surfaces and Method For Preparing Same," which is hereby incorporated by reference herein in its entirety, describes a process for preparing a flexible device having a superoleophobic surface comprising providing a flexible substrate; disposing a silicon layer on the flexible substrate; using photolithography to create a textured pattern in the silicon layer on the substrate wherein the textured pattern comprises a groove structure; and chemically modifying the textured surface by disposing a conformal oleophobic coating thereon; to provide a flexible device having a superoleophobic surface.

BACKGROUND

Fluid inkjet systems typically include one or more printheads having a plurality of inkjets from which drops of fluid are ejected towards a recording medium. The inkjets of a printhead receive ink from an ink supply chamber or manifold in the printhead which, in turn, receives ink from a source, such as a melted ink reservoir or an ink cartridge. Each inkjet includes a channel having one end in fluid communication with the ink supply manifold. The other end of the ink channel has an orifice or nozzle for ejecting drops of ink. The nozzles of the inkjets may be formed in an aperture or nozzle plate that has openings corresponding to the nozzles of the inkjets.

During operation, drop ejecting signals activate actuators in the inkjets to expel drops of fluid from the inkjet nozzles onto a recording medium. By selectively activating the actuators of the inkjets to eject drops as the recording medium and/or printhead assembly are moved relative to one another, the deposited drops can be precisely patterned to form particular text and graphic images on the recording medium. An example of a full width array printhead is described in U.S. Patent Application Publication No. 2009/0046125, which is hereby incorporated by reference herein in its entirety. An example of an ultra-violet curable gel ink that can be jetted in such a printhead is described in U.S. Patent Application Publication No. 2007/0123606, which is hereby incorporated by reference herein in its entirety. An example of a solid ink that can be jetted in such a printhead is the Xerox Color Qube™ cyan solid ink available from Xerox Corporation. U.S. Pat. No. 5,867,189, which is hereby incorporated by reference herein in its entirety, describes an inkjet print head including an ink ejecting component which incorporates an electropolished ink-contacting or orifice surface on the outlet side of the printhead.

One difficulty encountered with fluid inkjet systems is wetting, drooling, or flooding of inks onto the printhead front face. This contamination of the printhead front face can cause or contribute to blocking of the inkjet nozzles and channels, which alone or in combination with the wetted, contaminated front face, can cause or contribute to non-firing or missing drops, undersized or otherwise wrong-sized drops, satellites, or misdirected drops on the recording medium and thus result in degraded print quality. Current printhead front face coatings are typically sputtered fluoropolymer coatings, such as those from PTFE and PFA. When the printhead is tilted, a UV gel ink at a temperature of about 75° C. (75° C. being a typical jetting temperature for UV gel ink) and a solid ink at a temperature of about 105° C. (105° C. being a typical jetting temperature for solid ink) do not readily slide on the printhead front face surface. Rather, these inks flow along the printhead front face and leave an ink film or residue on the printhead that may interfere with jetting. Thus, the front faces of UV and solid ink printheads are prone to be contaminated by UV and solid inks. In some cases, the contaminated printhead can be refreshed or cleaned with a maintenance unit. However, this approach introduces system complexity, hardware cost, and sometimes reliability issues.

There remains a need for materials and methods for preparing devices having superoleophobic characteristics alone or in combination with superhydrophobic characteristics. Further, while currently available coatings for inkjet printhead front faces are suitable for their intended purposes, a need remains for an improved printhead front face design that reduces or eliminates wetting, drooling, flooding, and/or contamination of UV or solid ink over the printhead front face. There also remains a need for an improved printhead front face design that is ink phobic, that is, oleophobic, and robust to withstand maintenance procedures such as wiping of the printhead front face. There further remains a need for an improved printhead that is easily cleaned or that is self-cleaning, thereby eliminating hardware complexity, such as the need for a maintenance unit, reducing run cost, and improving system reliability.

The appropriate components and process aspects of each of the foregoing U.S. Patents and Patent Application Publications may be selected for the present disclosure in embodiments thereof. Further, throughout this application, various publications, patents, and published patent applications are referred to by an identifying citation. The disclosures of the publications, patents, and published patent applications referenced in this application are hereby incorporated by reference into the present disclosure to more fully describe the state of the art to which this invention pertains.

SUMMARY

Described is a process for producing an inkjet printhead comprising an aperture face having a highly oleophobic surface, or a superoleophobic surface, or a surface that is both superoleophobic and superhydrophobic. The process comprises providing an aperture plate; disposing a silicon layer on a surface of the aperture plate; using photolithography to create a textured pattern on an outer surface of the silicon layer, the textured pattern comprising a groove structure or an array of pillars; and chemically modifying the textured surface by disposing a conformal, oleophobic coating on the textured surface. The superoleophobic aperture plate may be used as a front face surface for an inkjet printhead.

EMBODIMENTS

The word "printer" as used herein encompasses any apparatus, such as a digital copier, bookmaking machine, facsimile machine, multi-function machine, etc., that performs a print outputting function for any purpose, including chemical and bioassay printed thin film devices, three-dimensional model building devices, and other applications.

Oleophobic refers to a property of a surface that is oil phobic (no affinity) with a hydrocarbon-based liquid, such as hexadecane. The greater the contact angle, the greater the oleophobicity of the surface. Surfaces that exhibit a liquid hydrocarbon contact angle greater than about 90° may be referred to as highly oleophobic, and surfaces that exhibit a liquid hydrocarbon contact angle greater than about 150° may be referred to as superoleophobic. However, it is to be understood that different liquid hydrocarbons may exhibit different contact angles with a given surface and, thus, the terms oleophobic, highly oleophobic, and superoleophobic as used herein are used to refer to a general property or characterization of the surface, and is not intended to describe a specific range of hydrocarbon contact angles.

Hydrophobic refers to a property of a surface that is phobic to water. The greater the contact angle, the greater the hydrophobicity of the surface. Surfaces that exhibit a water contact angle greater than about 120° may be referred to as highly hydrophobic, and surfaces that exhibit a water contact angle greater than about 150° may be referred to as superhydrophobic. However, it is to be understood that different liquids may exhibit different contact angles with a given surface and, thus, the terms hydrophobic, highly hydrophobic, and superhydrophobic as used herein are used to refer to a general property or characterization of the surface, and is not intended to describe a specific range of water contact angles.

For convenience, the embodiments disclosed herein will be described in conjunction with the manufacture of one form of an inkjet printhead shown in FIG. 1 and as described in greater detail in U.S. Pat. No. 5,867,189 to Whitlow et al. It is to be understood that embodiments are not limited to the manufacture of this particular type of inkjet printhead. Instead, the disclosure has broad applicability to inkjet printhead manufacture in general where it is desired to provide an aperture plate with a textured, oleophobic surface. The disclosure applies to inkjet printheads that dispense inks that are liquid at room temperature as well as hot melt or phase change inks that are solid at room temperature and are melted for ejection.

Figure 1:
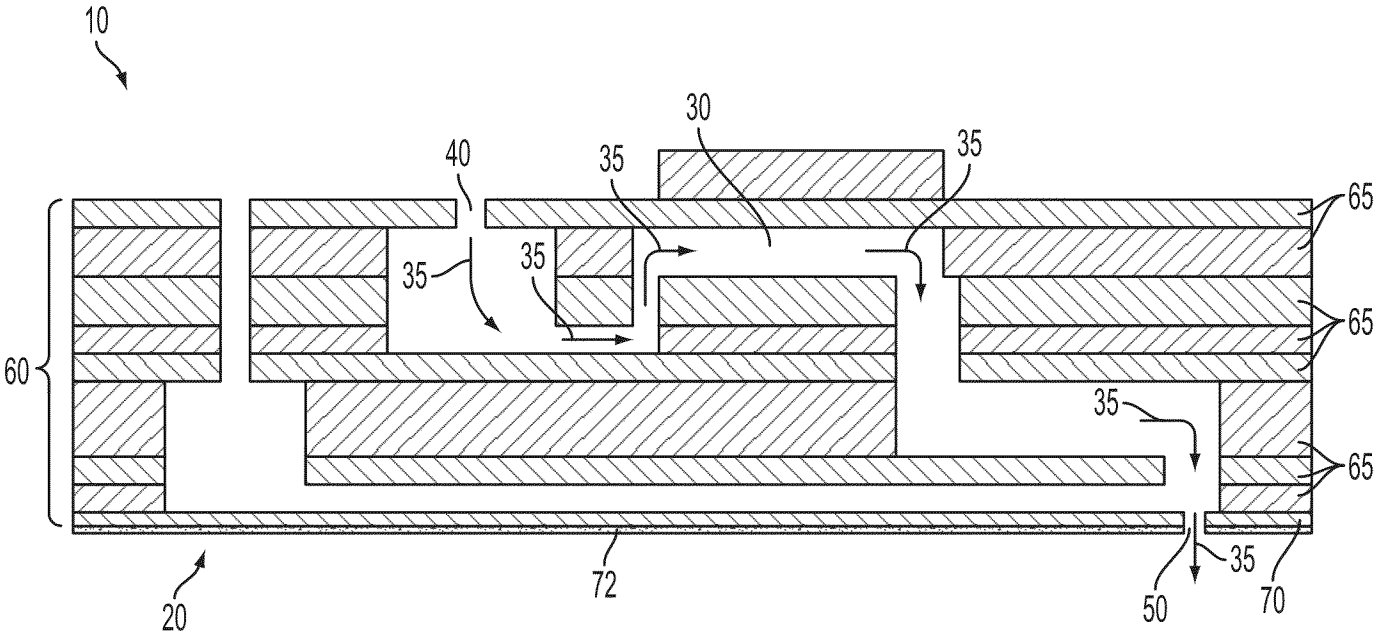
FIG. 1 is a schematic cross-sectional view of an inkjet printhead having a layer of silicon disposed on the outer surface of the aperture plate.

FIG. 1 illustrates an inkjet printhead 10 having a coating disposed thereon in accordance with the present disclosure. In FIG. 1, the printhead 10 has a body 20 comprised of a plurality of laminated plates or sheets 65 fabricated, for example, from stainless steel. These sheets 65 are aligned and stacked in a superposed relationship to form a jetstack 60. Jetstack sheets 65 may be etched or otherwise configured so that the jetstack has channels, chambers, and/or passageways. For example, as shown in FIG. 1, printhead 10 includes one or more ink pressure chamber 30 coupled to or in fluid communication with one or more ink source 40.

Inkjet printhead 10 also has an aperture plate 70 that is aligned and stacked in a superposed relationship with jetstack 60. Aperture plate 70 has one or more opening 50, also referred to herein as an orifice, aperture, or ink ejection nozzle, that is coupled to or is in fluid communication with an ink pressure chamber 30 by way of an ink passage indicated by arrows 35. Ink passes through nozzle 50 during ink drop formation. Ink drops travel in a direction along path 35 from nozzle 50 towards a print medium (not shown) that is spaced from nozzle 50.

Figure 2:
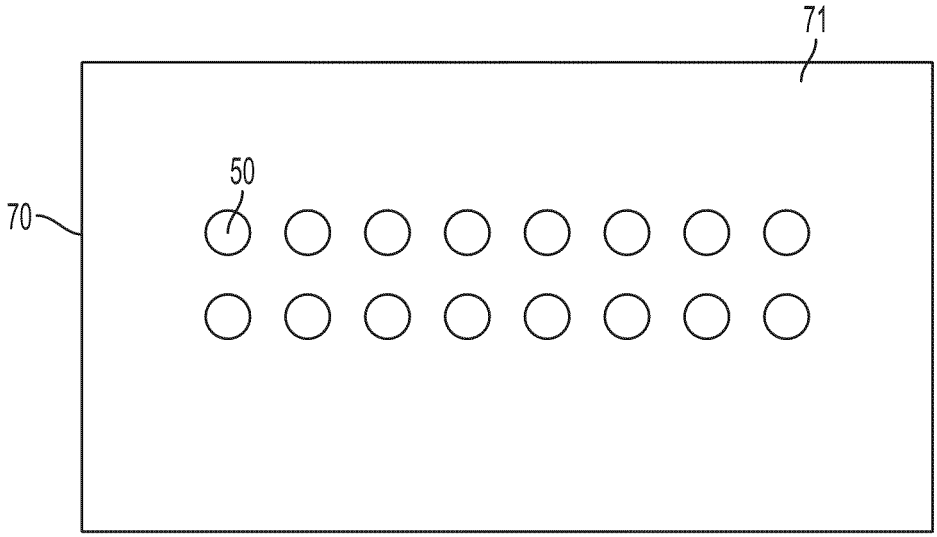
FIG. 2 is a schematic top view representation of an aperture plate before being coated with the silicon layer for an exemplary inkjet printhead.

A typical inkjet printhead includes a plurality of ink pressure chambers 30 with each pressure chamber 30 coupled to one or more nozzle 50. For simplification, a single nozzle 50 is illustrated in FIG. 1. As shown in FIG. 2, the aperture plate 70 may be configured with a plurality of nozzles 50 or an array of nozzles 50.

Aperture plate 70 defines at least a portion of an outlet side of printhead 10. Disposed or deposited on at least a portion of outlet surface 71 of aperture plate 70 facing the outlet side of printhead 10 is a layer of silicon 72 (not shown in FIG. 2).

The aperture plate may also be referred to as an orifice plate, nozzle plate, or printhead front face plate. The aperture plate may be made of a suitable material or composition, such as stainless steel, steel, nickel, copper, aluminum, polyimide, and silicon, and may be of any configuration suitable to the device. Aperture plates of square or rectangular shapes are typically selected due to ease of manufacture. Aperture plates may be made of stainless steel selectively plated with a braze material such as gold.

The jetstack sheets or plates, and the aperture plate, may be bonded together by any suitable method known in the art. In some embodiments, for example, the plates are stacked together and aligned, then subjected to a diffusion bonding process, and then subjected to a brazing process. Brazing of inkjet printhead metal plates is described in the art, such as, for example, in U.S. Pat. No. 4,875,619, the entire disclosure of which is totally incorporated herein.

To form the silicon layer, silicon, such as α-silicon, may be disposed or deposited onto a surface of the aperture plate by any suitable process known in the art, such as by sputtering, chemical vapor deposition, very high frequency plasma-enhanced chemical vapor deposition, microwave plasma-enhanced chemical vapor deposition, plasma-enhanced chemical vapor deposition, and use of ultrasonic nozzles in an in-line process, among others. The silicon layer may have any suitable thickness, such as from about 500 to about 5,000 nm, or from about 1,000 to about 5,000 nm, or from about 500 to about 2,500 nm, or from about 2,000 to about 4,000 nm, or about 3,000 nm.

The silicon layer may be formed on the aperture plate before or after the aperture plate is bonded with the other plates to form the jetstack. Because α-silicon has a melting point of around 1,150° C., an aperture plate having a layer of α-silicon can be subjected to bonding methods and/or other processes that require high heat, without melting the silicon layer. Additionally, the nozzles may be formed before or after the silicon layer is formed.

Textured patterns comprising a groove structure, such as micrometer-sized grooves, or an array of pillars may be provided on the silicon layer. The groove structure or pillar may comprise textured or wavy patterned vertical side walls and an overhang re-entrant structure defined on the top surface of the groove structure or pillar, or a combination thereof. Textured or wavy side walls as used herein can mean roughness on the sidewall that is manifested in the submicron range. In some embodiments, the wavy side walls have a 250 nm wavy structure with each wave corresponding to an etching cycle as described herein below.

Figure 3:
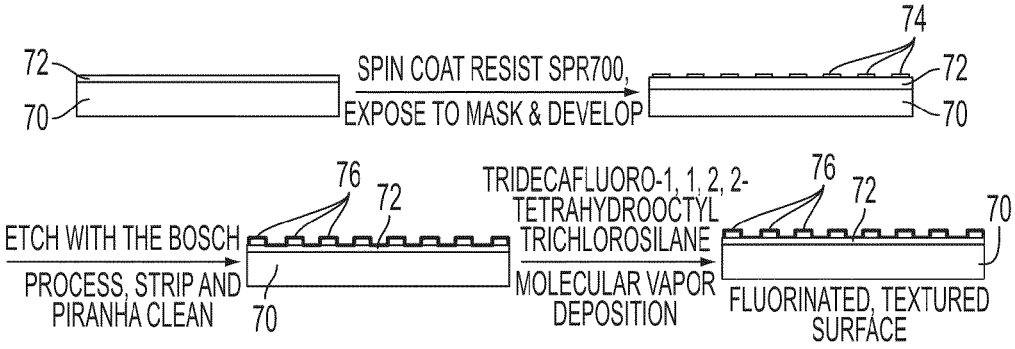
FIG. 3 is an illustration of a process scheme for preparing a fluorinated, textured surface on an aperture plate.
Figure 4:
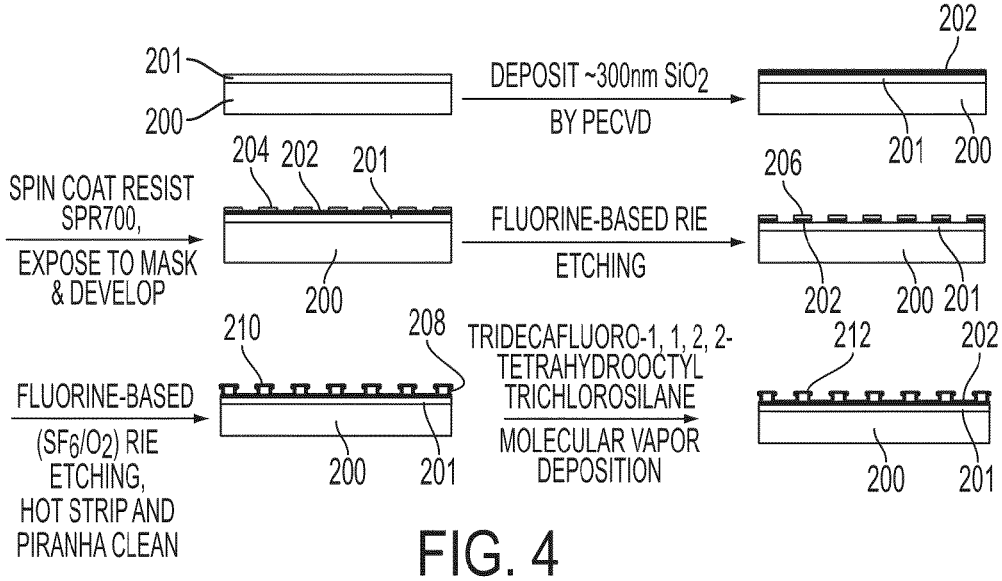
FIG. 4 is an illustration of another process scheme for preparing a fluorinated, textured surface on an aperture plate.

Referring to FIGS. 3 and 4, textured patterns 76 comprising a groove structure or an array of pillars may be created on a silicon-coated aperture plate using photolithography techniques. For example, the silicon layer 72 on aperture plate 70 may be prepared and cleaned in accordance with known photolithographic methods. A photoresist 74 can then be applied onto the silicon layer 72, such as by spin coating or slot die coating. Any suitable photoresist can be selected, such as Mega™Posit™ SPR™ 700 photoresist available from Rohm and Haas.

The photoresist 74 can then be exposed and developed according to methods as known in the art, typically by exposure to ultraviolet light and exposure to an organic developer such as a sodium hydroxide containing developer or a metal-ion free developer such as tetramethylammonium hydroxide.

A textured pattern 76 comprising a groove structure or an array of pillars can be etched by any suitable method as known in the art. Generally, etching can comprise using a liquid or plasma chemical agent to remove layers of the silicon that are not protected by the mask 74. Deep reactive ion etching techniques can be employed to produce the grooved structure with wavy sidewall.

After the etching process, the photoresist can be removed by any suitable method. For example, the photoresist can be removed by using a liquid resist stripper or a plasma-containing oxygen. The photoresist can be stripped using an $O_2$ plasma treatment such as the GaSonics Aura 1000 asking system available from Surplus Process Equipment Corporation, Santa Clara, Calif. Following stripping, the substrate can be cleaned, such as with a hot piranha cleaning process.

After the surface texture is created on the silicon layer, the surface texture can be chemically modified. Chemically modifying the textured substrate as used herein can comprise any suitable chemical treatment of the substrate, such as to provide or enhance the oleophobic quality of the textured surface. For example, the textured substrate surface may be chemically modified by disposing a self-assembled layer of perfluorinated alkyl chains onto the textured silicon surface. A variety of techniques, such as molecular vapor deposition, chemical vapor deposition, or solution coating may be used to deposit the self-assembled layer of perfluorinated alkyl chains onto the textured silicon surface. The self-assembled layer may comprise perfluorinated alkyl chains selected from tridecafluoro-1,1,2,2-tetrahydrooctyltrichlorosilane, tridecafluoro-1,1,2,2-tetrahydrooctyltrimethoxysilane, tridecafluoro-1,1,2,2-tetrahydrooctyltriethoxysilane, heptadecafluoro-1,1,2,2-tetrahydrooctyltrichlorosilane, heptadecafluoro-1,1,2,2-tetrahydrooctyltrimethoxysilane, heptadecafluoro-1,1,2,2-tetrahydrooctyltriethoxysilane, a combination thereof, and the like.

In a specific embodiment, the Bosch deep reactive ion etching process comprising pulsed or time-multiplexed etching is employed to create the textured groove surface structure. The Bosch process can use multiple etching cycles with three separate steps within one cycle to create a vertical etch: 1) deposition of a protective passivation layer, 2) Etch 1, an etching cycle to remove the passivation layer where desired, and 3) Etch 2, an etching cycle to etch the silicon isotropically. Each step lasts for several seconds. The passivation layer is created by $C_4F_8$ that is similar to Teflon® and protects the entire substrate from further chemical attack and prevents further etching. However, during the Etch 1 phase, the directional ions that bombard the substrate attack the passivation layer where desired. The ions collide with the passivation layer and sputter it off, exposing the desired area on the substrate to the chemical etchant during Etch 2. Etch 2 serves to etch the silicon isotropically for a short time (for example, from about 5 to about 10 seconds). A shorter Etch 2 step gives a smaller wave period (5 seconds leads to about 250 nanometers) and a longer Etch 2 yields longer wave period (10 seconds leads to about 880 nanometers). This etching cycle can be repeated until a desired groove height or pillar height is obtained. This etching cycle can be repeated until a desirable pillar height is obtained. In this process, pillars can be created having a textured or wavy sidewall wherein each wave corresponds to one etching cycle.

Therefore, in some embodiments, photolithography comprises using multiple etching cycles to create a vertical etch wherein each of the multiple etching cycles comprises a) depositing a protective passivation layer, b) etching to remove the passivation layer where desired, and c) etching the silicon isotropically; and d) repeating steps a) through c) until a desirable groove structure configuration is obtained. In this process, a groove structure can be created having a textured or wavy sidewall wherein each wave corresponds to one etching cycle. The groove structure may include wavy sidewalls, an overhang re-entrant structure, or a combination thereof.

The periodic "wave" structure may be any suitable size. For example, the size of each "wave" of the wavy sidewall of the groove structure may be from about 100 nm to about 1,000 nm, such as from about 100 nm to about 600 nm, or from about 400 nm to about 1,000 nm, or about 250 nm.

An embodiment of the present process comprises creating on an aperture plate a textured surface having an overhang re-entrant structure or structures. This process comprises an analogous process using a combination of two fluorine etchings processes ($CH_3F/O_2$ and $SF_6/O_2$). Referring to FIG. 4, the process comprises providing an aperture plate 200 having disposed thereon a cleaned silicon layer 201, depositing an $SiO_2$ thin film 202 on the cleaned silicon layer 201, such as via sputtering or plasma enhanced chemical vapor deposition, applying a photoresist material 204 to the silicon oxide 202 coated silicon layer 201 on aperture plate 200, exposing and developing the photoresist material 204, such as with 5:1 photolithography using SPR™ 700-1.2 photoresist, using fluorine-based reactive ion etching ($CH_3F/O_2$) to define a textured pattern 206 in the $SiO_2$ layer comprising a groove pattern or an array of pillars in the $SiO_2$ layer, using a second fluorine-based ($SF_6/O_2$) reactive ion etching process, followed by hot stripping, and piranha cleaning to create the textured pattern 208 having overhang re-entrant structures 210 on the topmost layer. The textured pattern 206 can then be coated with a conformal oleophobic coating 212 to provide a superoleophobic aperture plate comprising a textured grooved pattern having an overhang re-entrant structure on the top surface thereof or comprising a textured pattern of pillars having straight side walls and overhang re-entrant structures.

The aperture plate having an oleophobic surface may be prepared using roll-to-roll web fabrication technology. For example, a roll comprising a substrate passes through a first station where a layer of amorphous silicon is deposited on the substrate, such as by chemical vapor deposition or sputtering, followed by slot die coating with photoresist, followed by a second station comprising a masking and exposing/developing station, followed by an etching station, followed by a cleaning station. The textured substrate can then pass through a coating station where the textured substrate can be modified with a conformal oleophobic coating.

Figure 5:
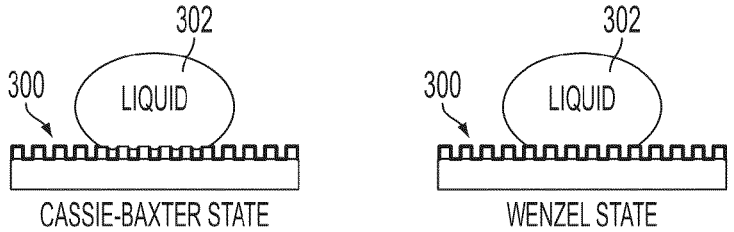
FIG. 5 is an illustration showing the states of liquid droplets on textured surfaces.

FIG. 5 depicts the two states commonly used to describe the composite liquid-solid interface between liquid droplets on rough surfaces. In FIG. 5, a surface modified with a textured pattern 300 is shown where a liquid droplet 302 is shown in the Cassie-Baxter state and the Wenzel state. The static contact angles for the droplet 302 at the Cassie-Baxter state ($\theta_{CB}$) and the Wenzel state ($\theta_W$) are given by equations (1) and (2), respectively:

$$\cos\theta_{CB}=R_f f\cos\theta_\gamma+f-1 \quad (1)$$

$$\cos\theta_W=r\cos\theta_\gamma \quad (2)$$

where f is the area fraction of projected wet area, $R_f$ is the roughness ratio on the wet area and $R_f f$ is solid area fraction, r is the roughness ratio, and $\theta_\gamma$ is the contact angle of the liquid droplet with a flat surface.

In the Cassie-Baxter state, the liquid droplet "sits" primarily on air with a very large contact angle ($\theta_{CB}$). According to the equation, liquid droplets will be in the Cassie-Baxter state if the liquid and the surface have a high degree of phobicity, for example, when $\theta_\gamma \geq 90°$.

With respect to hydrocarbon-based liquid, for example, ink, as exemplified by hexadecane, the textured surfaces comprising a groove structure having overhang re-entrant structures formed on the top surface of the groove structure renders the surface "phobic" enough (that is, $\theta_\gamma=73°$) to result in the hexadecane droplet forming the Cassie-Baxter state at the liquid-solid interface of the textured, oleophobic surface.

Figure 6:
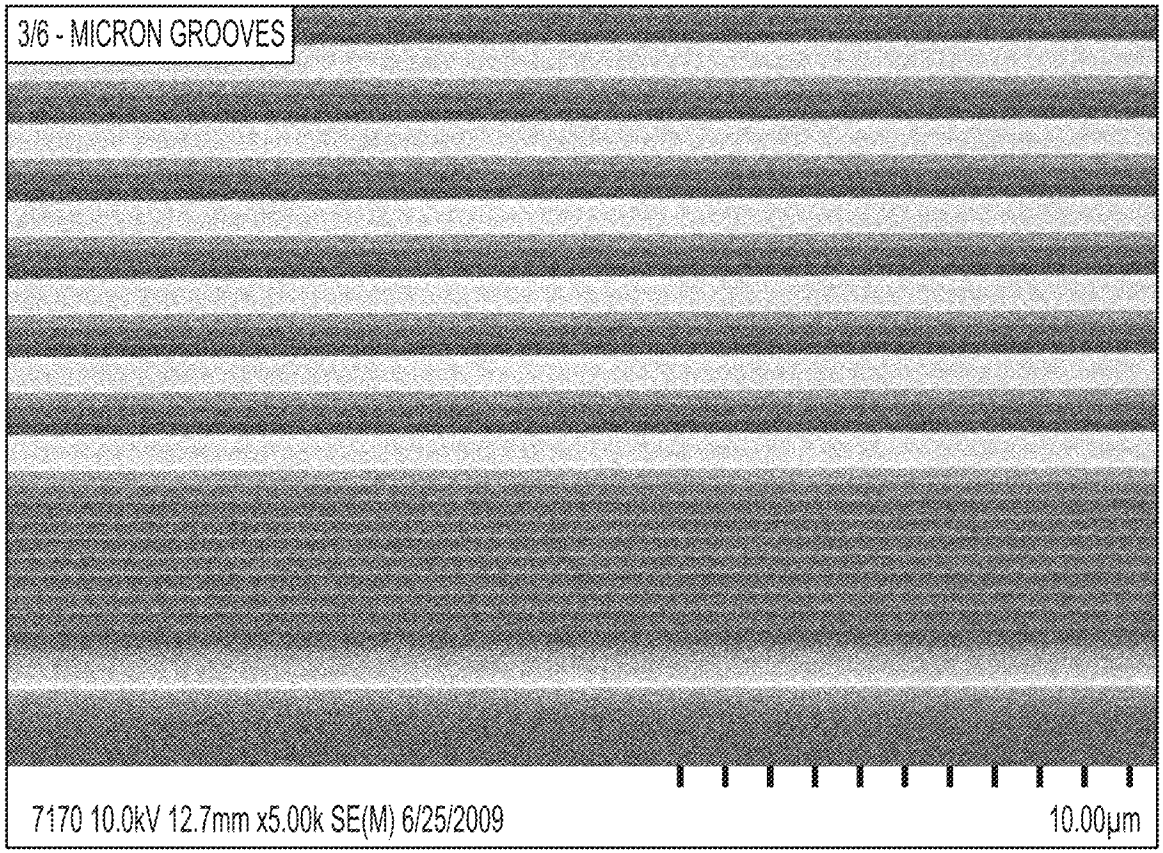
FIG. 6 is a micrograph of a fluorosilane-coated textured surface comprising groove structures having textured (wavy) sidewalls.
Figure 7:
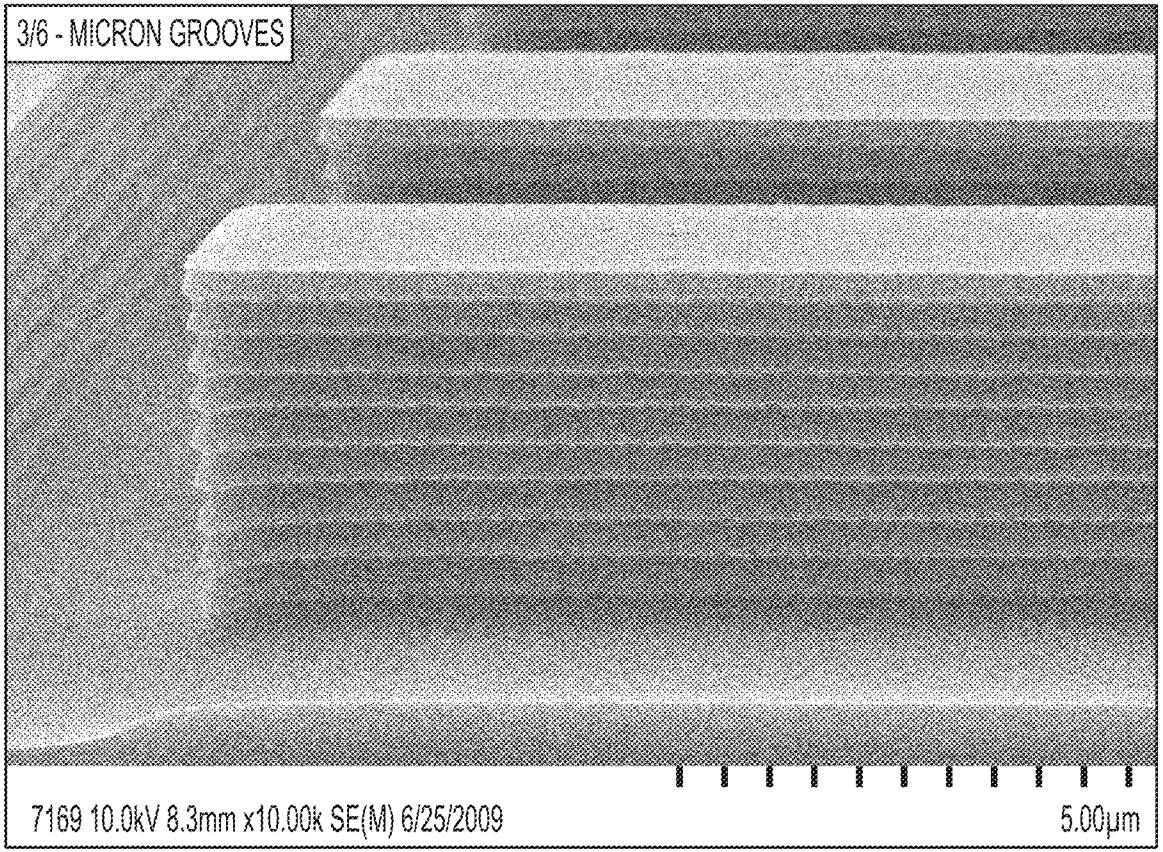
FIG. 7 is an alternate view of the surface of FIG. 6.

FIG. 6 is a micrograph of a structure comprising fluorosilane-coated grooves 3 micrometers in width and 6 micrometers in pitch. FIG. 7 provides an alternate view of the structure of FIG. 6, showing the wavy side wall structure with the top surface forming an overhang re-entrant structure.

Figure 8:
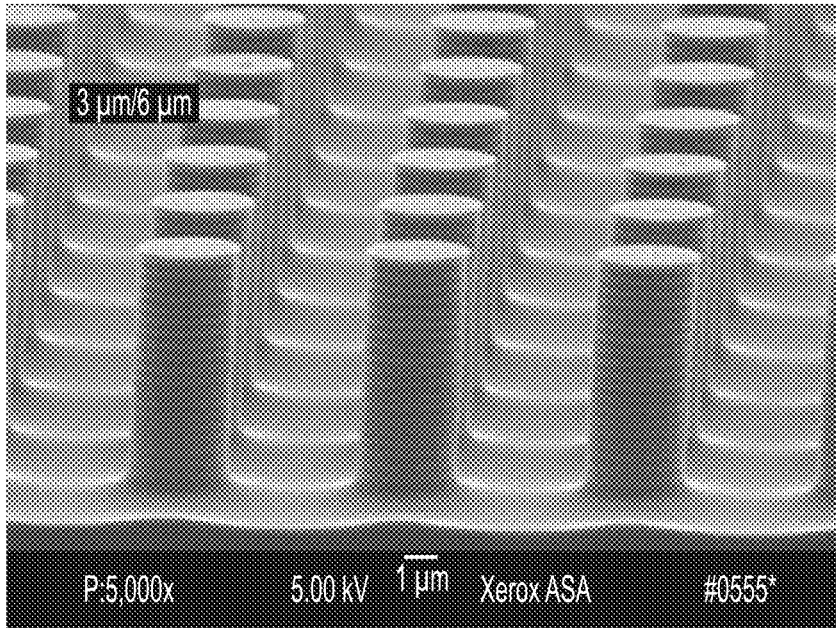
FIG. 8 is a micrograph of a fluorosilane-coated textured surface comprising an array of pillar structures having textured (wavy) sidewalls.
Figure 9:
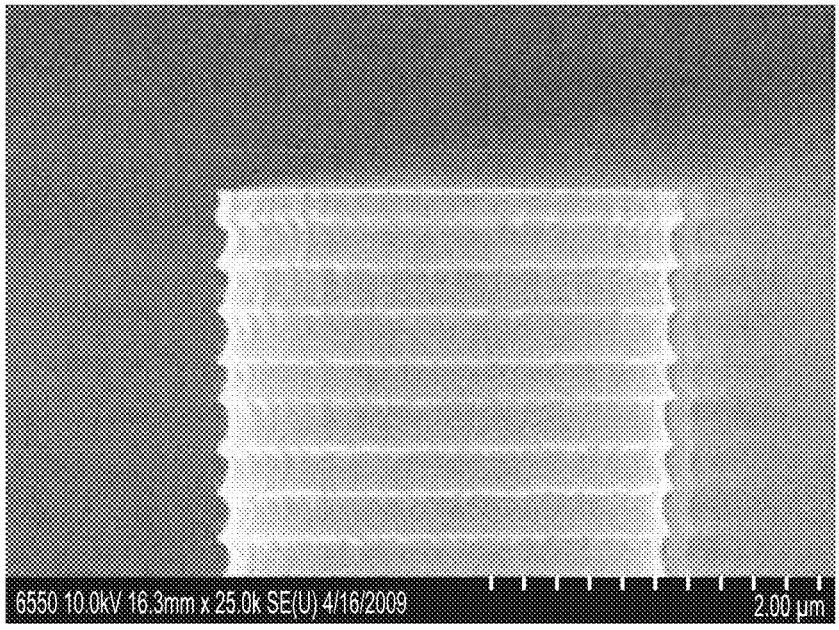
FIG. 9 is an enlarged view of a portion of the surface of FIG. 8 showing details of the wavy sidewall pillar structure.
Figure 10:
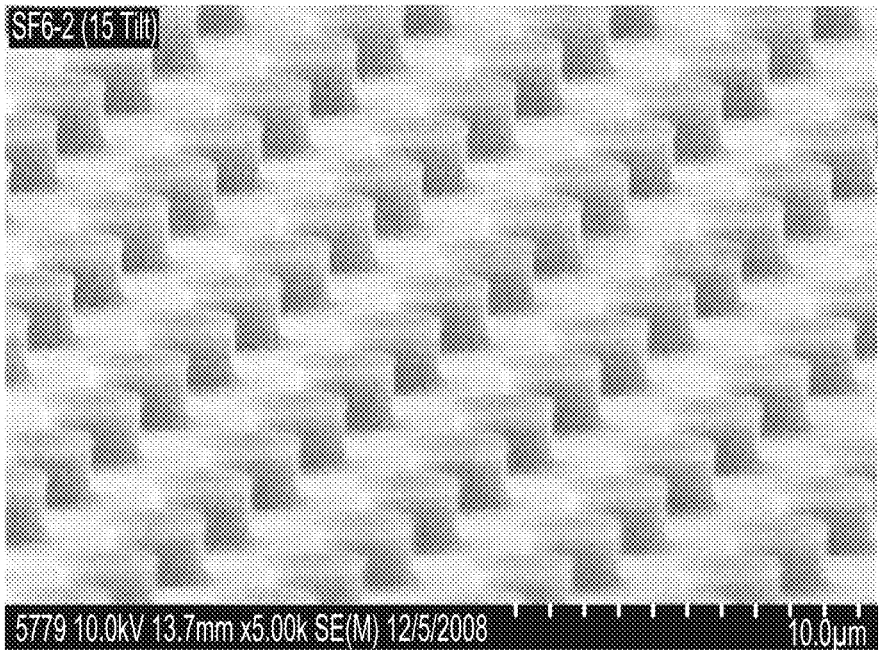
FIG. 10 is a micrograph of a fluorosilane-coated textured surface comprising an array of pillar structures having an overhang structure.
Figure 11:
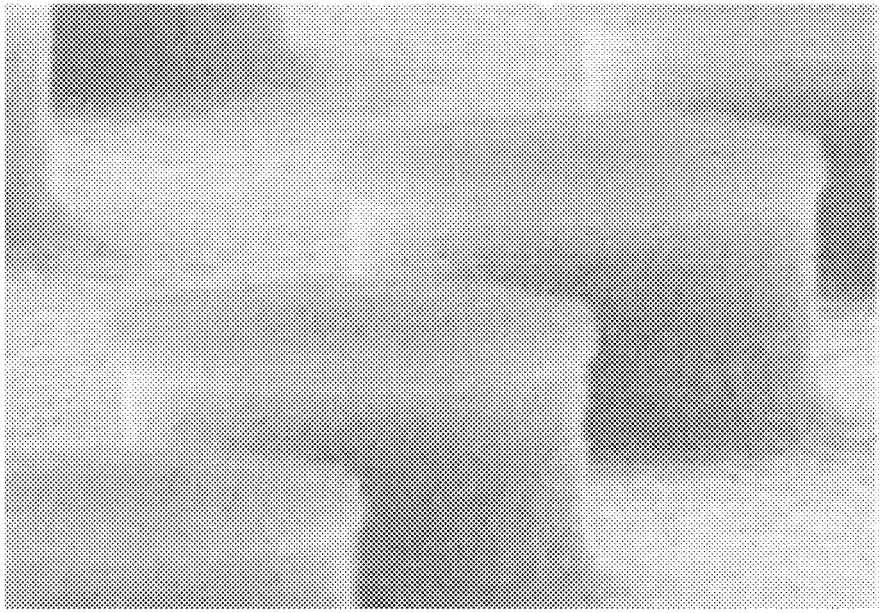
FIG. 11 is an enlarged view of a portion of the surface of FIG. 10 showing details of the over-hang feature.

FIG. 8 is a micrograph of a fluorosilane-coated textured surface comprising an array of pillar structures having textured (wavy) sidewalls. FIG. 9 provides an enlarged view of a portion of the surface of FIG. 8, showing details of the wavy side wall pillar structure. FIG. 10 provides a micrograph of a fluorosilane-coated textured surface comprising an array of pillars having overhang re-entrant structures defined on the top of the pillars. FIG. 11 provides an enlarged view of a portion of the surface of FIG. 10 showing details of the overhang re-entrant feature.

The groove structure can have any suitable spacing or density or solid area coverage. For example, the groove structure may have a solid area coverage of from about 0.5% to about 40%, or from about 1% to about 20%.

The groove structure can have any suitable width and pitch. For example, the grove structure may have a width of from about 0.5 to about 10 micrometers, or from about 1 to about 5 micrometers, or about 3 micrometers. Further, the groove structure may have a groove pitch of from about 2 to about 15 micrometers, or from about 3 to about 12 micrometers, or about 6 micrometers.

The groove structure can have any suitable shape. The overall groove structure can have a configuration designed to form a specific pattern. For example, the groove structure can have a configuration selected to direct a flow of liquid in a selected flow pattern.

The groove structure can be defined at any suitable or desired total height. The textured surface may comprise groove pattern having a total height of from about 0.3 to about 5 micrometers, or from about 0.3 to about 4 micrometers, or from about 0.5 to about 4 micrometers.

The pillar array can have any suitable spacing or pillar density or solid area coverage. The array of pillars may have a solid area coverage of from about 0.5% to about 40%, or from about 1% to about 20%. The pillar array can have any suitable spacing or pillar density. For example, the array of pillars may have a pillar center-to-pillar center spacing of about 6 micrometers.

The pillar array can have any suitable shape, such as round, elliptical, square, rectangular, triangle, star-shaped, or the like.

The pillar array can have any suitable diameter or equivalent diameter. For example, the array of pillars can have diameter of from about 0.1 to about 10 micrometers, or from about 1 to about 5 micrometers.

The pillars can be defined at any suitable or desired height. For example, the textured surface can comprise an array of pillars having a pillar height of from about 0.3 to about 10 micrometers, or from about 0.3 to about 4 micrometers, or from about 0.5 to about 3 micrometers.

Figure 12:
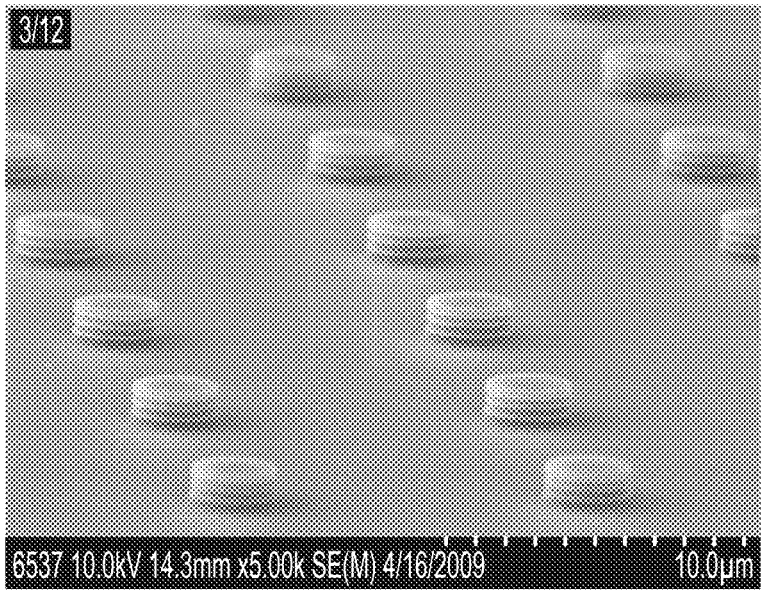
FIG. 12 is a micrograph of a superoleophobic textured surface comprising an array of pillars having a 1.1 micrometer pillar height.
Figure 13:
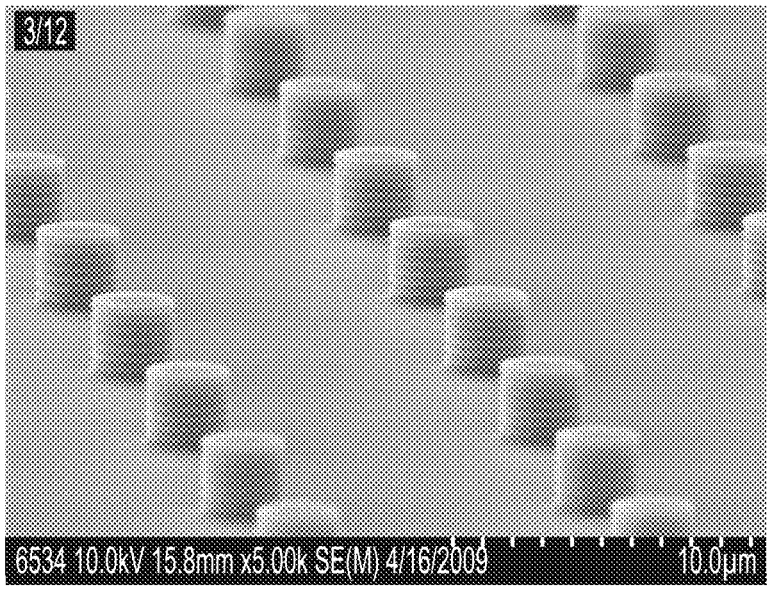
FIG. 13 is a micrograph of a superoleophobic textured surface comprising an array of pillars having a 3.0 micrometer pillar height.

In FIG. 12, a micrograph shows a superoleophobic textured surface comprising an array of pillars having a 1.1 micrometer pillar height. In FIG. 13, a micrograph shows a superoleophobic textured surface comprising an array of pillars having a 3.0 micrometer pillar height.

Figure 14:
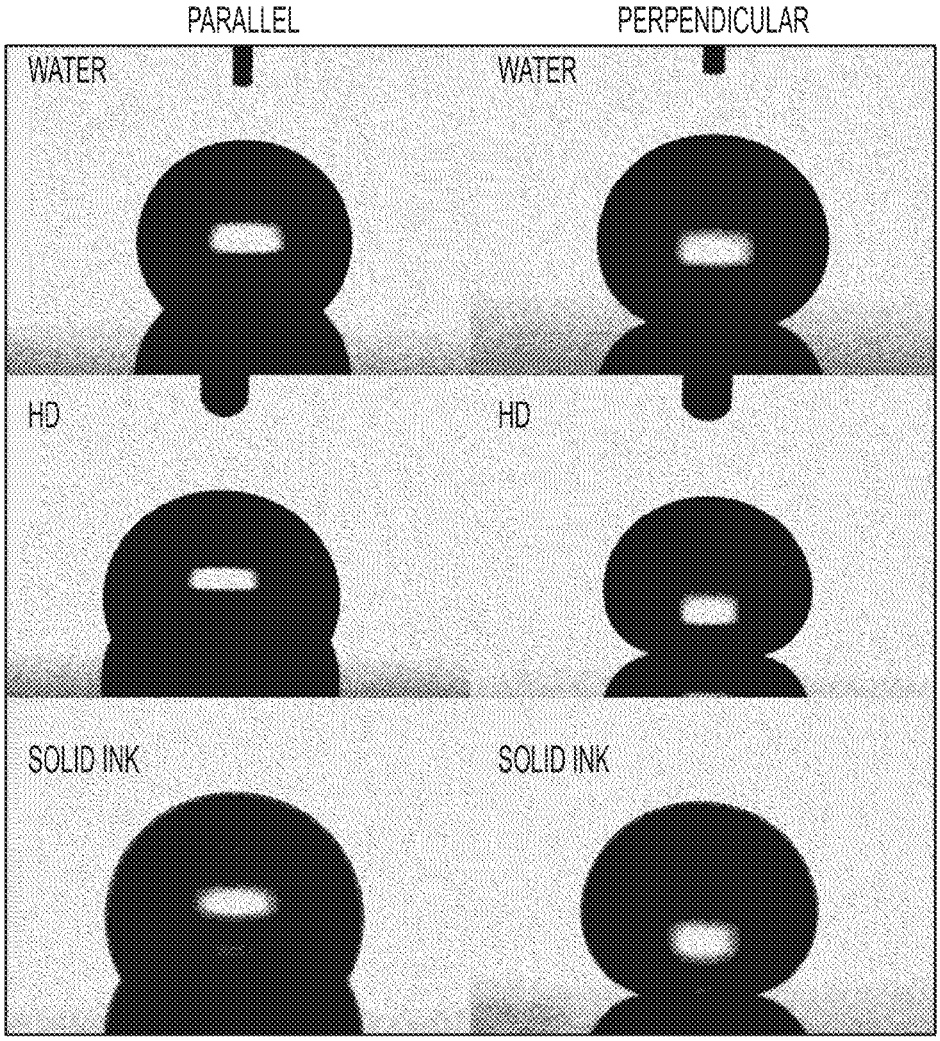
FIG. 14 comprises photographs showing sessile drops of water, hexadecane (HD), and solid ink on the groove structure from the parallel (left column) and perpendicular (right column) direction.

The surface properties of the fluorinated textured surfaces were studied by determining both static and dynamic contact angle measurements. FIG. 14 is a set of photographs showing sessile drops of water, hexadecane (HD), and solid ink from the parallel direction and the perpendicular direction on fluorosilane-coated textured surfaces prepared on a silicon wafer comprising groove structures.

While not wishing to be bound by theory, the inventors believe that the high contact angles observed for the FOTS textured surface with water and hexadecane is the result of the combination of surface texturing and fluorination. In specific embodiments, the textured devices comprise at least one of a wavy side wall feature or an overhang re-entrant structure at the top surface textured structure to provide flexible superoleophobic devices. The inventors believe that the re-entrant structure on the top surface of the groove structure and pillar structure is a significant driver for superoleophobicity.

Superoleophobic films prepared using photolithography via the roll-to-roll web manufacturing process and comprising textured groove patterns or textured patterns of pillars on the flexible silicon film as described herein can be processed for use as inkjet printhead parts. Nozzles may then be created on the film, for example using laser ablation techniques or mechanical means (such as hole punching). Printhead size film can be cut, aligned and attached, such as glued, onto the nozzle front face plate for inkjet printhead applications. This textured nozzle front face will be superoleophobic and will overcome the wetting and drooling problems that is problematic in certain current printheads. If desired, the textured patterns may have a height of 3 micrometers. Further, superoleophobicity can be maintained with pattern height as low as 1 micron. With reduced pattern height, the mechanical robustness of the shallow textured patterns increases. Very little to no surface damage is observed when manually rubbing these superoleophobic patterns.

In further embodiments, the groove structure provides improved mechanical robustness in combination with extremely low sliding angles in the parallel direction for an advantageous directional self-cleaning property, rendering its use as a self-cleaning, no-maintenance front face for solid ink and UV ink printheads. This anisotropic wetting and directional cleaning can be a great advantage for areas adjacent to the edges of the nozzle as well as areas far away from the nozzle. High contact angle in the orthogonal direction assists with any residual ink pinning and directional self cleaning in the parallel direction helps to re-direct the ink away from the nozzle and eventually remove the ink from the front face. Accordingly, residual ink will not puddle in the vicinity of the nozzle nor accumulate on the front plate causing problems such as ink wetting/drooling/flooding on the printhead front face.

The present inventors have demonstrated that superoleophobic surfaces (for example, wherein hexadecane droplets faint a contact angle of greater than about 150° and a sliding angle of less than about 10° with the surface) can be fabricated by simple photolithography and surface modification techniques on a silicon wafer. The prepared superoleophobic surface is very "ink phobic" and has the surface properties very desirable for the front face of inkjet printheads, for example, high contact angle with ink for super de-wetting and high holding pressure and low sliding angle for self clean and easy clean. Generally, the greater the ink contact angle the better (higher) the holding pressure. Holding pressure measures the ability of the aperture plate to avoid ink weeping out of the nozzle opening when the pressure of the ink tank (reservoir) increases.

Inkjet printheads in accordance with this disclosure comprise an aperture plate having an oleophobic surface. The oleophobic surface may exhibit a hexadecane contact angle of from about 90° to about 175°, or from about 120° to about 170°, or from about 150° to about 175°, or from about 150° to about 160°. The oleophobic surface may also exhibit a hexadecane sliding angle of from about 1° to about 30°, or from about 1° to about 25°, or from about 1° to about 15°, or from about 1° to about 10°.

The oleophobic surface may also be hydrophobic and exhibit a water contact angle of from about 120° to about 180°, such as for example, a water contact angle of from about 130° to about 180°, or from about 150° to about 180°. The oleophobic surface may also exhibit a water sliding angle of from about 1° to about 30°, or from about 1° to about 25°, or from about 1° to about 15°, or from about 1° to about 10°.

Because contact angles and sliding angles vary with the size of the drop being tested, the contact angles and sliding angles discussed herein are made in reference to a drop of a test substance having a volume of from about 5 to about 10 μL.

In some embodiments, the aperture plate comprises a superoleophobic surface where hexadecane has a contact angle with the surface of from greater than about 90° to about 175° in a direction that is either parallel to the groove direction or perpendicular to the groove direction. In further embodiments, the aperture plate comprises a superoleophobic surface where hexadecane has a sliding angle with the surface of less than about 30° in parallel to a groove direction.

EXAMPLES

The following Examples are being submitted to further define various species of the present disclosure. These Examples are intended to be illustrative only and are not intended to limit the scope of the present disclosure. Also, parts and percentages are by weight unless otherwise indicated.

Table 1 summarizes contact angle data and sliding angle data for a number of relevant surfaces with water, hexadecane, solid ink, and ultraviolet curable gel ink. Contact angle and sliding angle measurements were conducted on an OCA20 goniometer from Dataphysics (Germany), which includes a computer-controlled automatic liquid dispensing system, computer controlled tilting stage, and a computer-based image processing system. In typical static contact angle and sliding angle measurements, test liquid droplets include about 5 to 10 μL of a test substance selected from water, hexadecane, solid ink, and UV ink gently deposited on the testing surface. The static angle was determined by the computer software (SCA20) and each reported data is an average of more than 5 independent measurements. Sliding angle measurements were performed by tilting the base unit at a rate of about 1°/sec using titling base unit TBU90E. The sliding angle was defined and measured as the angle where the test liquid droplet starts to move.

Example 1 is a new stainless steel printhead (with PFA coating) from manufacturing.

Example 2 is a used stainless printhead (with PFA coating) from manufacturing

Example 3 is a commercial PTFE film.

Example 4 is a superoleophobic surface comprising pillar structures with 3 μm dia./6 μm pitch.

Example 5 is a superoleophobic surface comprising groove structures with 3 μm width/6 μm pitch, in the parallel direction.

TABLE 1

| | Water | | Hexadecane | | Solid ink (~105° C.) | | UV ink (~75° C.) | |
|---|---|---|---|---|---|---|---|---|
| Example | Contact angle | Sliding angle | Contact angle | Sliding angle | Contact angle | Sliding angle | Contact angle | Sliding angle |
| 1 | ~130° | >90° | ~71° | ~64° | ~85 | ~40-70 | ~63 | Flowing leaving thin ink film |
| 2 | ~85° | >90° | ~30° | Flowing leaving thin film | N.A. | N.A. | N.A. | N.A. |
| 3 | ~118° | ~64° | ~48° | ~31° | ~63° | >90° | ~58° | >90° |
| 4 | ~156° | ~10° | ~158° | ~10° | ~155° | ~33°-58° | N.A. | N.A. |
| 5 | ~131° | ~8° | ~113° | ~4° | ~120° | ~25° | N.A. | N.A. |

N.A. = not available

It will be appreciated that various of the above-disclosed and other features and functions, or alternatives thereof, may be desirably combined into many other different systems or applications. Also, various presently unforeseen or unanticipated alternatives, modifications, variations or improvements therein may be subsequently made by those skilled in the art, and are also intended to be encompassed by the following claims.

What is claimed is:

1. A method for producing an inkjet printhead comprising an aperture plate having an oleophobic surface, the method comprising:

disposing a silicon layer on an aperture plate;

using photolithography to create a textured pattern in the silicon layer on the aperture plate to form a textured silicon surface; and chemically modifying the textured silicon surface by depositing a conformal oleophobic coating material on the textured surface, wherein the using photolithography step further comprises using multiple etching cycles, each of the multiple etching cycles comprising depositing a protective passivation layer on the silicon layer, etching to remove at least a portion of the protective passivation layer, and etching the silicon layer isotropically.

2. The method of claim 1, wherein the conformal oleophobic coating material is deposited on the textured silicon surface by a molecular vapor deposition technique, a chemical vapor deposition technique, or a solution self assembly technique.

3. The method of claim 2, wherein the conformal oleophobic coating material comprises a self-assembling fluorosilane compound.

4. The method of claim 1, wherein the textured pattern comprises an array of pillars, an array of pillars having an overhang re-entrant structure disposed on said pillars, an array of pillars having textured, wavy sidewalls, or a combination thereof.

5. The method of claim 4, wherein the pillars are round, elliptical, square, rectangular, triangle, or star-shaped.

6. The method of claim 4, wherein the array of pillars has a solid area coverage of from about 0.5% to about 40%.

7. The method of claim 1, wherein the textured pattern is selected from the group consisting of a groove pattern, a groove pattern including an overhang re-entrant structure, a groove pattern including textured, wavy sidewalls, or a combination thereof.

8. The method of claim 7, wherein a height of the groove pattern is about 0.5 to about 5 micrometers.

9. The method of claim 1, wherein the textured pattern has a configuration that directs a flow of liquid in a desired flow pattern.

10. The method of claim 1, wherein the textured pattern comprises an array of pillars having a pillar height of about 0.5 to about 5 micrometers.

11. The method of claim 1, wherein the textured pattern comprises pillars or groove structures having a textured sidewall comprises a plurality of waves, each wave having an amplitude of from about 100 nanometers to about 1,000 nanometers.

12. The method of claim 1, wherein the oleophobic conformal coating is formed from a precursor comprising tridecafluoro-1,1,2,2-tetrahydrooctyltrichlorosilane, tridecafluoro-1,1,2,2-tetrahydrooctyltrimethoxysilane, tridecafluoro-1,1,2,2-tetrahydrooctyltriethoxysilane, heptadecafluoro-1,1,2,2-tetrahydrooctyltrichlorosilane, heptadecafluoro-1,1,2,2-tetrahydrooctyltrimethoxysilane, heptadecafluoro-1,1,2,2-tetrahydrooctyltriethoxysilane, or a combination thereof.

13. The method of claim 1, wherein the silicon layer comprises a silicon.

14. The method of claim 1, wherein the aperture plate comprises stainless steel.

15. The method of claim 1, further comprising:

bonding the aperture plate to a stack of one or more jetstack plates.

16. The method of claim 15, wherein the silicon layer is disposed on the aperture plate before the aperture plate is bonded to the stack of one or more jetstack plates.

17. The method of claim 15, wherein the silicon layer is disposed on the aperture plate before the aperture plate is bonded to the stack of one or more jetstack plates.

18. The method of claim 1, wherein the oleophobic surface exhibits a hexadecane contact angle of from about 90° to about 175°.

19. The method of claim 18, wherein the oleophobic surface further exhibits a hexadecane sliding angle of from about 1° to about 30°.

20. The method of claim 19, wherein the oleophobic surface further exhibits a water contact angle of from about 120° to about 180°.

21. The method of claim 18, wherein the oleophobic surface further exhibits a water sliding angle of from about 1° to about 30°.

22. The method of claim 1, wherein the etching cycles are repeated until a desirable groove configuration is obtained.

* * * * *